US009217600B2

(12) United States Patent
Malisi

(10) Patent No.: US 9,217,600 B2
(45) Date of Patent: Dec. 22, 2015

(54) NO-FROST REFRIGERATION DEVICE

(75) Inventor: Michaela Malisi, Heidenheim (DE)

(73) Assignee: BSH BOSCH UND SIEMENS HAUSGERÄTE GmbH, Munich (DE)

( * ) Notice: Subject to any disclaimer, the term of this patent is extended or adjusted under 35 U.S.C. 154(b) by 947 days.

(21) Appl. No.: 13/266,462

(22) PCT Filed: Apr. 29, 2010

(86) PCT No.: PCT/EP2010/055811

§ 371 (c)(1),
(2), (4) Date: Oct. 27, 2011

(87) PCT Pub. No.: WO2010/133435

PCT Pub. Date: Nov. 25, 2010

(65) Prior Publication Data

US 2012/0042683 A1 Feb. 23, 2012

(30) Foreign Application Priority Data

May 20, 2009 (DE) ..... 10 2009 003 263

(51) Int. Cl.
*F25D 17/06* (2006.01)

(52) U.S. Cl.
CPC ..... *F25D 17/067* (2013.01); *F25D 2317/0655* (2013.01); *F25D 2317/0665* (2013.01); *F25D 2317/0671* (2013.01)

(58) Field of Classification Search
CPC ..... F25D 17/065; F25D 17/067; F25D 2317/0655; F25D 2317/0665
USPC ..... 62/42, 426
See application file for complete search history.

(56) References Cited

U.S. PATENT DOCUMENTS

| | | | | |
|---|---|---|---|---|
| 3,834,779 | A * | 9/1974 | Turner | F25D 23/00 220/592.06 |
| 4,075,866 | A | 2/1978 | Williamitis | |
| 2004/0172964 | A1 * | 9/2004 | Brachert et al. | 62/407 |
| 2009/0205356 | A1 | 8/2009 | Collins et al. | |

FOREIGN PATENT DOCUMENTS

| | | | | |
|---|---|---|---|---|
| CN | 101263351 | | 9/2008 | |
| DE | WO 2007031457 | A2 * | 3/2007 | F04D 29/668 |
| EP | 1722178 | A2 | 11/2006 | |
| EP | WO2007031457 | A2 * | 3/2007 | F04D 29/66 |

(Continued)

OTHER PUBLICATIONS

English Translation of the First Office Action for corresponding Chinese Application No. 2010800221305, issued May 15, 2013, 5 pages.
International Search Report PCT/EP2010/055811.
English Translation of Russian Decision on Granting for corresponding Russian Application No. 2011148075, dated Feb. 12, 2014, 4 pages.

*Primary Examiner* — Emmanuel Duke
(74) *Attorney, Agent, or Firm* — Nixon & Vanderhye P.C.

(57) ABSTRACT

A no-frost refrigeration device includes at least one storage chamber for items to be cooled; and an evaporator chamber which is formed by a two-part first housing having first and second housing parts. The first housing part has, at least locally, a flexible surface, and the second housing part has formed thereon a rib which is pressed in a sealing manner into the flexible surface. A ventilator is located in the evaporator chamber for driving air circulation running through the storage chamber and the evaporator chamber.

20 Claims, 3 Drawing Sheets

(56) References Cited

FOREIGN PATENT DOCUMENTS

| | | | |
|---|---|---|---|
| GB | 2 378 237 | A | 2/2003 |
| SU | 1717911 | A1 | 3/1992 |
| WO | 2007031457 | A2 | 3/2007 |

* cited by examiner

NO-FROST REFRIGERATION DEVICE

BACKGROUND OF THE INVENTION

The present invention relates to a refrigeration device, particularly a domestic refrigeration device, having a no-frost design.

A no-frost refrigeration device conventionally comprises at least one storage chamber for items to be cooled and an evaporator chamber in which an evaporator and a ventilator are accommodated. The ventilator serves to drive air circulation running through the storage chamber and the evaporator chamber, and by means of which the storage chamber is cooled. The storage chamber and the evaporator chamber of a device of this type are usually surrounded by a common housing, the interior space of which is divided by an intermediate wall into the evaporator chamber and the storage chamber.

Moisture introduced into the refrigerator with the items to be cooled or by opening the door should condense only on the evaporator, since in a period when the evaporator and the ventilator are out of operation, the evaporator can be defrosted and the moisture collecting thereon can be conducted out of the appliance without resulting in noticeable warming of the items to be cooled in the storage chamber.

A problem can arise if the route of the air between the storage chamber and the evaporator chamber is not sufficiently precisely defined. Ideally, the entirety of the air drawn out of the storage chamber should be conducted past the evaporator in the evaporator chamber in order to dehumidify said air at the evaporator and to prevent residual moisture condensing out on the ventilator. If, however, there is not an adequate seal between the evaporator chamber and the storage chamber, it can occur that air leaking out of the storage chamber is drawn through gaps between the separating wall and the housing directly into the intermediate space of the evaporator chamber which lies, in terms of flow, between the evaporator and the ventilator. The relatively warm and moist leakage air mixes in the intermediate space with the air cooled at the evaporator. As a result of the consequent cooling, the relative air humidity can rise to over 100%, with the result that condensation forms on surfaces lying further downstream. If too much condensation collects at the ventilator, the ventilator can ice up, with the result that the storage chamber can no longer be cooled.

Furthermore, air leakage impairs the energy efficiency of the refrigeration device since firstly, the driving energy expended by the ventilator to draw in the leakage air does not contribute to cooling the storage chamber, and secondly, in order to achieve a desired temperature in the storage chamber, the evaporator must be cooled to a temperature that is all the lower, the stronger is the leakage air stream.

BRIEF SUMMARY OF THE INVENTION

It is therefore desirable to design a no-frost refrigeration device from the outset such that the leakage air quantity drawn in by the ventilator remains restricted to a minimum.

This aim is achieved in a no-frost refrigeration device having at least one storage chamber for items to be cooled and an evaporator chamber, comprising an evaporator and a ventilator for driving air circulation running through the storage chamber and the evaporator chamber, wherein the evaporator chamber comprises a housing having at least two parts, the first housing part having, at least locally, a flexible surface, and a rib formed on the second housing part is pressed in a sealing manner into the flexible surface.

Preferably, the second housing part is an intermediate wall which separates the evaporator chamber from the storage chamber.

The flexible surface on the other hand can be part of a common housing or can be mounted on a common housing which surrounds the storage chamber and the evaporator chamber.

If the storage chamber and the evaporator chamber are delimited, in known manner, by a common inner container, the flexible surface can suitably be part of a covering element mounted on the inside of the inner container.

The flexible surface is preferably made from a closed-pore foam material, particularly expanded polystyrene (EPS).

The second housing part can be made, for example, from a flexible layer glued into the inner container. Preferably, however, said housing part is configured as a rigid integral molded part, since a molded part of this type can be made more exactly conforming to a wall contour of the second housing part than the inner container, which is generally formed by deep-drawing.

If the ventilator is arranged downstream of the evaporator, the rib should suitably seal at least one intermediate space of the evaporator chamber lying, in the direction of flow, between the evaporator and the ventilator.

A mounting for the ventilator can suitably be formed on the second housing part. The rib can then suitably extend round a suction aperture of the ventilator formed in the second housing part.

BRIEF DESCRIPTION OF THE DRAWINGS

Further features and advantages of the invention are disclosed by the following description of exemplary embodiments, making reference to the accompanying drawings, in which.

DETAILED DESCRIPTION OF EXEMPLARY EMBODIMENTS OF THE PRESENT INVENTION

Figure 1:
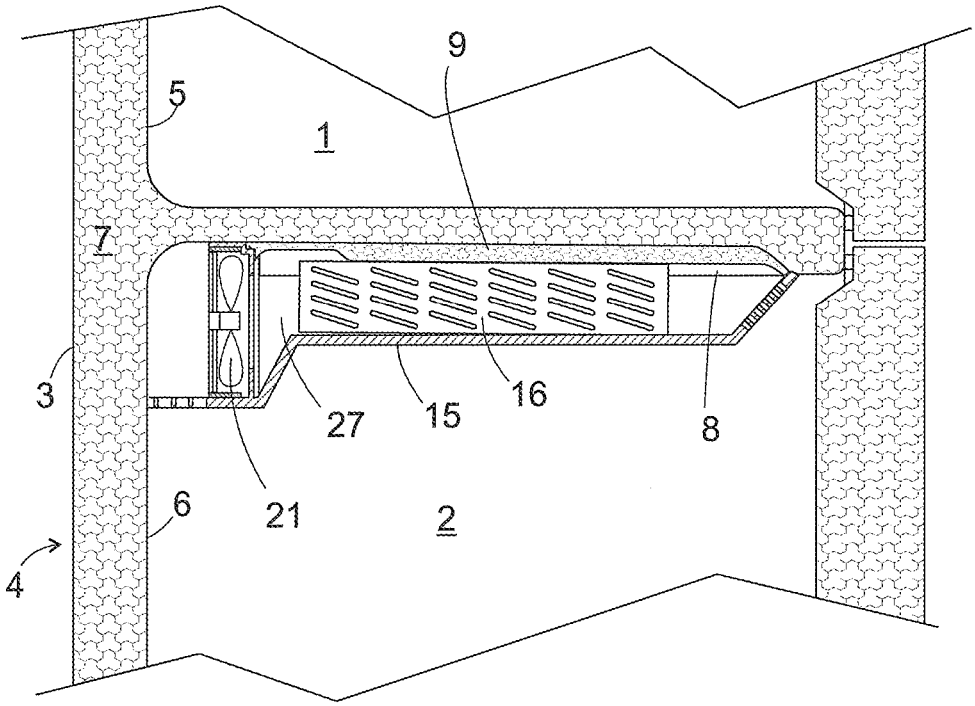
FIG. 1 is a schematic representation of a vertical section through a no-frost refrigeration device according to the invention.

FIG. 1 shows a schematic part section through the housing of a combination refrigeration device comprising an upper and a lower storage compartment 1 and 2. The walls of the refrigeration device have a construction which is per se known, with a solid outer skin 3 which can consist of various materials, depending on whether the device is a built-in or a freestanding device, whether a wall concerned is a side wall or a rear wall 4, an inner container 5 or 6 deep-drawn from flat plastic material and an insulating material layer 7 enclosed between the outer skin 3 and the inner container 5.

Figure 2:
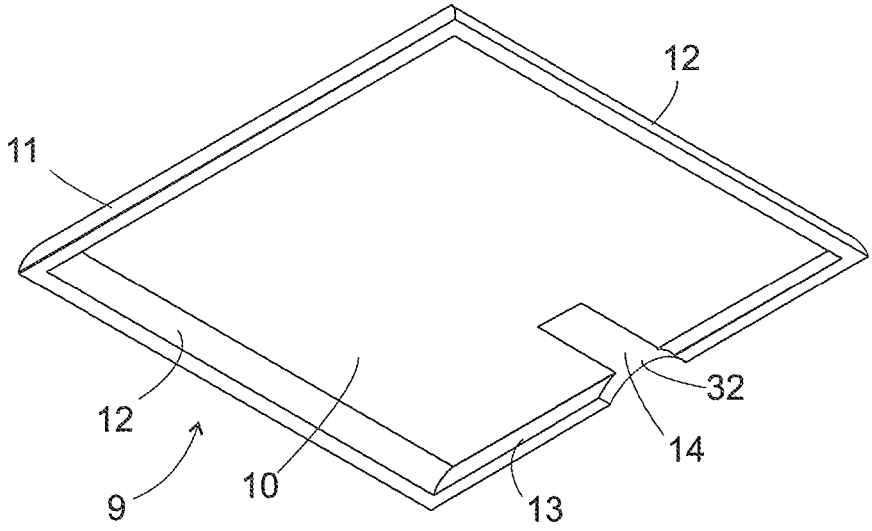
FIG. 2 is a perspective view of a first housing part of an evaporator chamber of the refrigeration device of FIG. 1.

Embodied on the roof of the lower inner container 6 is an undercut 8 which extends as far as close to the front edge of the roof. Said undercut 8 is lined over a large proportion of the surface thereof with a shell-like molded part 9 made from closed-pore foam material, particularly EPS; only an edge region of the cover close to the rear wall is recessed. The molded part 9, which is shown in a perspective view obliquely from below in FIG. 2, largely consists of a planar plate 10, the upper side of which lies against the cover of the inner container 6 and is surrounded at the edges by four downwards directed webs, of which the front web 11 and the side webs 12 are arranged obliquely, following the form of a front edge of the undercut 8 or a rounding between the cover and the side walls of the inner container, whereas a rear web 13, which is arranged at a distance from the rear wall 4, is vertically oriented. The rear web 13 is divided by a central circular arc-shaped recess 14. The recess 14 extends as far as into the central planar plate 10 of the molded part 9. The plane of section in FIG. 1 extends through the recess 14.

Figure 3:
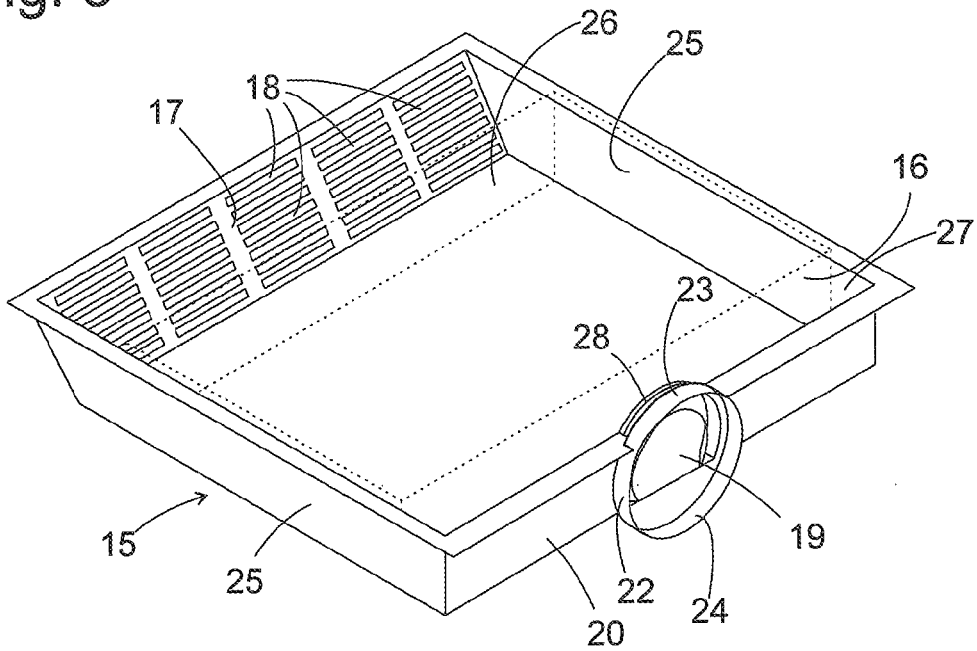
FIG. 3 is a perspective view of an evaporator shell as the second housing part of the evaporator chamber of the refrigeration device of FIG. 1.
Figure 4:
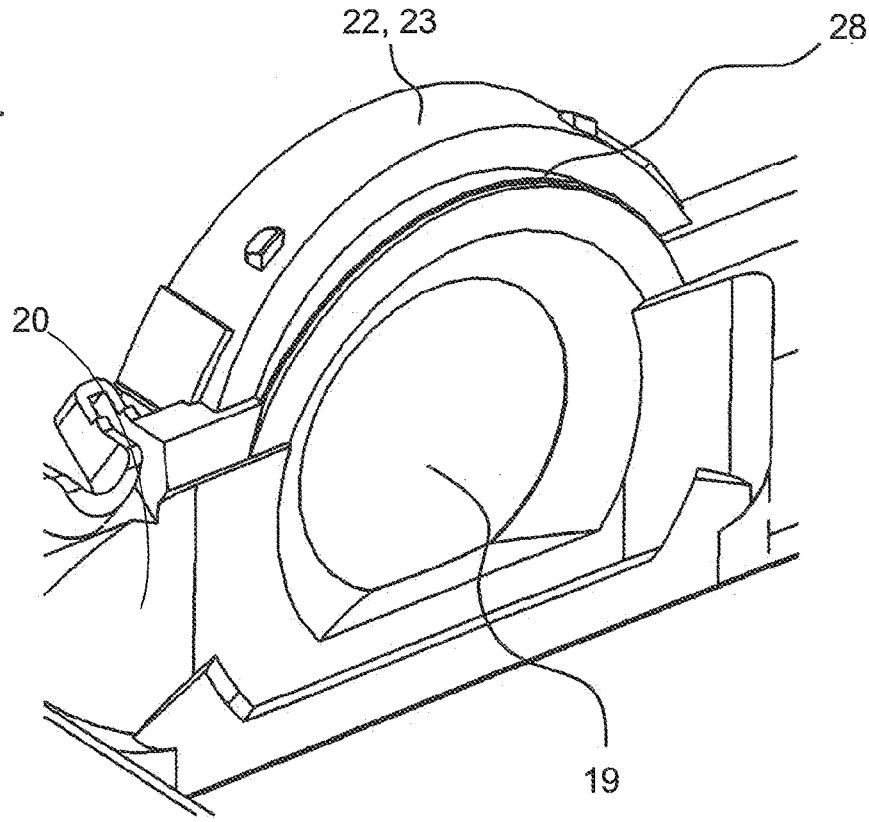
FIG. 4 is a detail of the evaporator shell in a perspective view.

FIG. 3 shows a schematic perspective view of an evaporator shell 15 injection molded from plastics which is provided in order to form, together with the molded part 9, a housing for an evaporator 16. Formed in an oblique front wall 17 of the evaporator shell 15 are inlet apertures 18 through which the air can pass from the storage chamber 2 into the evaporator housing. Formed in a rear wall 20 of the evaporator shell 15 is a suction aperture 19 for a ventilator 21 (not shown in FIG. 3). The ventilator 21 is intended to be inserted into a mounting formed by an outer annular web 22 surrounding the suction aperture 19 and provided on the exterior of the rear wall 20. In order to be able to accommodate a sufficiently large powerful ventilator, the diameter of the web 22 is larger than the height of the actual evaporator shell, and sections 23, 24 of the web 22 extend upwards beyond the otherwise horizontal upper edges of the front and rear walls 17, 20 and of the side walls 25 of the evaporator shell 15, and downwards below a base 26 of the shell. The recess 14 in the molded part 9 is provided in order to accommodate part of the upwards-extending section 23.

The evaporator 16 represented in FIG. 3 schematically as a transparent cuboid is arranged in the shell 15 such that said evaporator fills the entire free cross-section of the evaporator housing formed by the shell 15 and the molded part 9 and air which flows through the evaporator chamber from the inlet apertures 18 to the suction aperture 19 is forced to pass the evaporator 16 and is thereby cooled and dehumidified.

Leakage air drawn in by the ventilator without passing the evaporator 16 and mixing in an intermediate space 27 between the evaporator 16 and the rear wall 20 with cold air from the evaporator 16 could cause icing up of the ventilator 21. It is therefore important, particularly in the vicinity of the intermediate space 27, to ensure that the edges of the molded part 9 and the evaporator shell 15 lie tightly against one another. In order to ensure this, particularly in the region of section 23, a sharp-edged, radially outwards extending rib 28 is formed thereon which, when during assembly of the refrigeration device, the evaporator shell 15 is pressed against the molded part 9, and presses in cutting manner into the molded part 9 at the height of the recess 14.

In a separating wall between two storage chambers 1, 2, passages can be provided between the storage chambers and the valves or flaps, said passages enabling the air circulation driven by the ventilator 21 to be conducted through the storage chamber 2 or the storage chamber 1.

Figure 5:
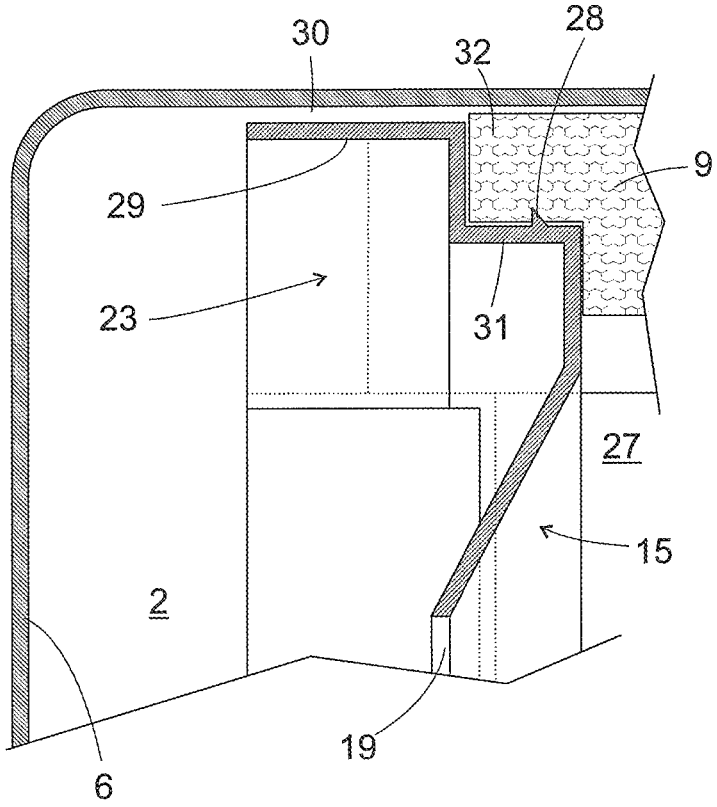
FIG. 5 is a detail of the refrigeration device in a sectional view in the direction of the depth of the device housing.

FIG. 5 shows an enlarged section through a rear upper corner of the inner container 6 and part of the rear wall with the suction aperture 19 formed therein. Clearly apparent is a stepped shape of the edge section 23 with a rear region of larger diameter 29 which is separated from the cover of the inner container 6 only by a narrow gap 30, and a front region 31 of smaller diameter. The diameter of the front region 31 must be selected sufficiently smaller than the diameter of the rear region 29, so that an edge section 32 of the molded part 9 fits into the intermediate space between the front region 31 and the cover of the inner container 6, the thickness of said edge section being sufficient in order not to become broken when, during assembly, the rib 28 arranged at the front region 31 cuts into the edge section 32.

Naturally, the rib 28 must not be restricted to the section 23, but can extend over other regions of the upper edge of the evaporator shell 15. In general, however, the rib 28 does not extend forwardly past the evaporator 16, since a lack of seal between the molded part 9 and the shell 15 upstream from the evaporator 16 has no effect on the tendency of the ventilator to ice up and can be accepted.

The invention claimed is:

1. A no-frost refrigeration device, comprising:

at least one storage chamber for items to be cooled;

an evaporator chamber formed by a two-part first housing having first and second housing parts, said first housing part having, at least locally, a flexible surface, and said second housing part having formed thereon a rib which is pressed in a sealing manner into the flexible surface; and a ventilator located in the evaporator chamber for driving air circulation running through the storage chamber and the evaporator chamber, wherein the first housing part is disposed such that a first surface thereof directly opposes a wall of the storage chamber, the first housing part including a second surface opposite the first surface, the second surface at least at least partially delimiting an interior of the evaporator chamber.

2. The no-frost refrigeration device of claim 1, constructed in the form of a no-frost domestic refrigeration device.

3. The no-frost refrigeration device of claim 1, wherein the second housing part is an intermediate wall which separates the evaporator chamber from the storage chamber.

4. The no-frost refrigeration device of claim 1, further comprising a second housing in surrounding relationship to the storage chamber and the evaporator chamber, said flexible surface being mounted on the second housing.

5. The no-frost refrigeration device of claim 1, wherein the flexible surface is part of a covering element which is mounted internally on a common inner container of the storage chamber and the evaporator chamber.

6. The no-frost refrigeration device of claim 1, wherein the flexible surface is made from a closed-pore foam material.

7. The no-frost refrigeration device of claim 6, wherein the closed-pore foam material is expanded polystyrene (EPS).

8. The no-frost refrigeration device of claim 1, wherein the first housing part is a rigid integral molded part.

9. The no-frost refrigeration device of claim 1, further comprising an evaporator arranged in the evaporator chamber, said ventilator being arranged downstream from the evaporator, with the rib sealing an intermediate space of the evaporator chamber lying, in a direction of flow, between the evaporator and the ventilator.

10. The no-frost refrigeration device of claim 1, further comprising a mount provided on the second housing part for the ventilator.

11. The no-frost refrigeration device of claim 1, wherein the rib extends around a suction aperture of the ventilator formed in the second housing part.

12. A no-frost refrigeration device, comprising:

at least one storage chamber for items to be cooled;

an evaporator chamber formed by first and second housing parts, said first housing part having, at least locally, a flexible surface, and said second housing part having formed thereon a rib which is pressed in a sealing manner into the flexible surface; and a ventilator located in the evaporator chamber for driving air circulation running through the storage chamber and the evaporator chamber, wherein one of the first and second housing parts forms an open compartment configured to receive an evaporator and the other of the first and second housing parts forms a cover which closes the open compartment to form the evaporator chamber when the rib is pressed into the flexible surface.

13. The no-frost refrigeration device of claim 12, constructed in the form of a no-frost domestic refrigeration device.

14. The no-frost refrigeration device of claim 12, wherein the second housing part is an intermediate wall which separates the evaporator chamber from the storage chamber.

15. The no-frost refrigeration device of claim 12, further comprising a second housing in surrounding relationship to the storage chamber and the evaporator chamber, said flexible surface being mounted on the second housing.

16. The no-frost refrigeration device of claim 12, wherein the flexible surface is made from a closed-pore foam material.

17. The no-frost refrigeration device of claim 16, wherein the closed-pore foam material is expanded polystyrene (EPS).

18. The no-frost refrigeration device of claim 12, wherein the first housing part is a rigid integral molded part.

19. The no-frost refrigeration device of claim 12, further comprising an evaporator arranged in the evaporator chamber, said ventilator being arranged downstream from the evaporator, with the rib sealing an intermediate space of the evaporator chamber lying, in a direction of flow, between the evaporator and the ventilator.

20. The no-frost refrigeration device of claim 12, wherein the rib extends around a suction aperture of the ventilator formed in the second housing part.

* * * * *